US007325998B2

(12) United States Patent
Leonhardt et al.

(10) Patent No.: US 7,325,998 B2
(45) **Date of Patent: *Feb. 5, 2008**

(54) BOLLARD LAMP

(75) Inventors: Michael Leonhardt, Castaic, CA (US); Tori C. Poppenheimer, La Canada-Flintridge, CA (US); David Crookham, Valencia, CA (US); Nicole Skogg, Los Angeles, CA (US)

(73) Assignee: Acuity Brands, Inc., Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/539,446

(22) Filed: Oct. 6, 2006

(65) Prior Publication Data

US 2007/0076416 A1 Apr. 5, 2007

Related U.S. Application Data

(62) Division of application No. 11/213,343, filed on Aug. 25, 2005, now Pat. No. 7,182,547.

(51) Int. Cl.
*F21V 7/00* (2006.01)

(52) U.S. Cl. ..... 404/9; 362/290; 362/296; 362/342

(58) Field of Classification Search ..... 362/290, 362/292, 296, 341, 342, 362, 153.1; 404/9; 40/563, 582; 116/63 R
See application file for complete search history.

(56) References Cited

U.S. PATENT DOCUMENTS

| | | | | |
|---|---|---|---|---|
| 2,147,008 | A | 2/1939 | Blumenthal | 362/291 |
| 4,096,555 | A | 6/1978 | Lasker | 362/302 |
| 4,231,080 | A | 10/1980 | Compton | 362/298 |
| 4,591,960 | A | 5/1986 | Jones | 362/298 |
| 4,814,961 | A | 3/1989 | O'Brien et al. | 362/319 |
| 4,969,074 | A | 11/1990 | Davis et al. | 362/329 |
| 4,999,749 | A | 3/1991 | Dormand | 362/153.1 |
| 5,142,463 | A | 8/1992 | Panagotacos et al. | 362/285 |
| 5,628,558 | A | 5/1997 | Iacono et al. | 362/288 |
| 6,341,877 | B1 | 1/2002 | Chong | 362/291 |
| 6,402,337 | B1 | 6/2002 | LeVasseur et al. | 362/153.1 |

FOREIGN PATENT DOCUMENTS

GB 2403499 A * 1/2005

* cited by examiner

*Primary Examiner*—John Anthony Ward
(74) *Attorney, Agent, or Firm*—Connolly Bove Lodge & Hutz LLP

(57) ABSTRACT

A bollard includes a bollard post having a lamp which includes a louver stack. The louver stack includes louvers spaced apart in the longitudinal direction of the bollard post. The bollard post is rectangular in cross section and the louver stack extends outwardly beyond the periphery of the bollard. There is a primary light source inwardly of the louver stack and a mechanism for providing light downwardly about the base end of the bollard post. One such mechanism includes an LED providing a light wash down the bollard post from beneath where that louver extends outwardly of the periphery of the bollard post. A second mechanism employs a top reflector above the primary light source to reflect light downwardly about the light source. Bottom reflector surfaces direct the light from the top reflector outwardly to louver reflectors located beneath the lowermost louver. Such reflectors can reflect light downwardly for light wash of the bollard post and an illumination about the base of the bollard post. The spacing between the lowermost louver and the periphery of the bollard post is exposed to the primary light source to create additional light downwardly to about the bollard post.

1 Claim, 4 Drawing Sheets

BOLLARD LAMP

BACKGROUND OF THE INVENTION

This is a divisional application of U.S. application Ser. No. 11/213,343, filed Aug. 25, 2005 now U.S. Pat. No. 7,182,547, the disclosure of which is incorporated herein by reference.

BACKGROUND OF THE INVENTION

The field of the present invention is bollard lighting.

Traditional stacked louvered bollards with a single light source centered within a louver stack atop the bollard have a dark spot or shadow around the base of the bollard. The louvers typically extend to the outside edge of the base and direct light away from the bollard and immediate surrounding area.

The shadow around the base of traditional stacked louvered bollard lamps prevents the area close to the bollard from being illuminated. Because of this, such bollards are typically displaced from paths and the like in order to achieve appropriate illumination of such paths. This typically requires unnecessary space for the path. Alternatively, the illumination for an area can rely on overlapping areas of illumination from adjacent bollards. Naturally, this adds to the number of bollards required for any given design.

SUMMARY OF THE INVENTION

The present invention is directed to bollards employing a lamp atop the bollard post. The lamp includes a louver stack with louvers spaced apart in the longitudinal direction of the bollard post. At least the lowermost louver extends outwardly past the periphery of the top end of the bollard post in at least one location. A primary light source inwardly of the louvers provides a conventional source of lighting.

In a first aspect of the present invention, an LED provides a down light means. The LED is mounted beneath the louver most adjacent to the bollard. The LED may be directed as a light wash down to the bollard post.

In a second aspect of the present invention, a top reflector about the primary light source reflects light downwardly about the primary light source to a bottom reflector below and outwardly of the light source. The bottom reflector is inclined to reflect the received light from the top reflector outwardly toward the louver most adjacent the bollard post. A louver reflector then directs the light downwardly to about the base of the bollard, defining a down light means.

Features of the means employing reflected light from the primary light source may include multiple surfaces on the louver reflector to spread light and even provide a light wash down the bollard post. The lowermost louver may extend fully past the periphery of the top end of the bollard post such that the opening defined between the post and the louver may be exposed to the primary light source for additional lighting about the base of the bollard.

In further aspect of the present invention, any of the foregoing aspects are contemplated to be employed in combination to greater effect.

Accordingly, it is an object of the present invention to provide improved illumination by a bollard lamp. Other and further objects and advantages will appear hereinafter.

DETAILED DESCRIPTION OF THE PREFERRED EMBODIMENTS

Figure 1:
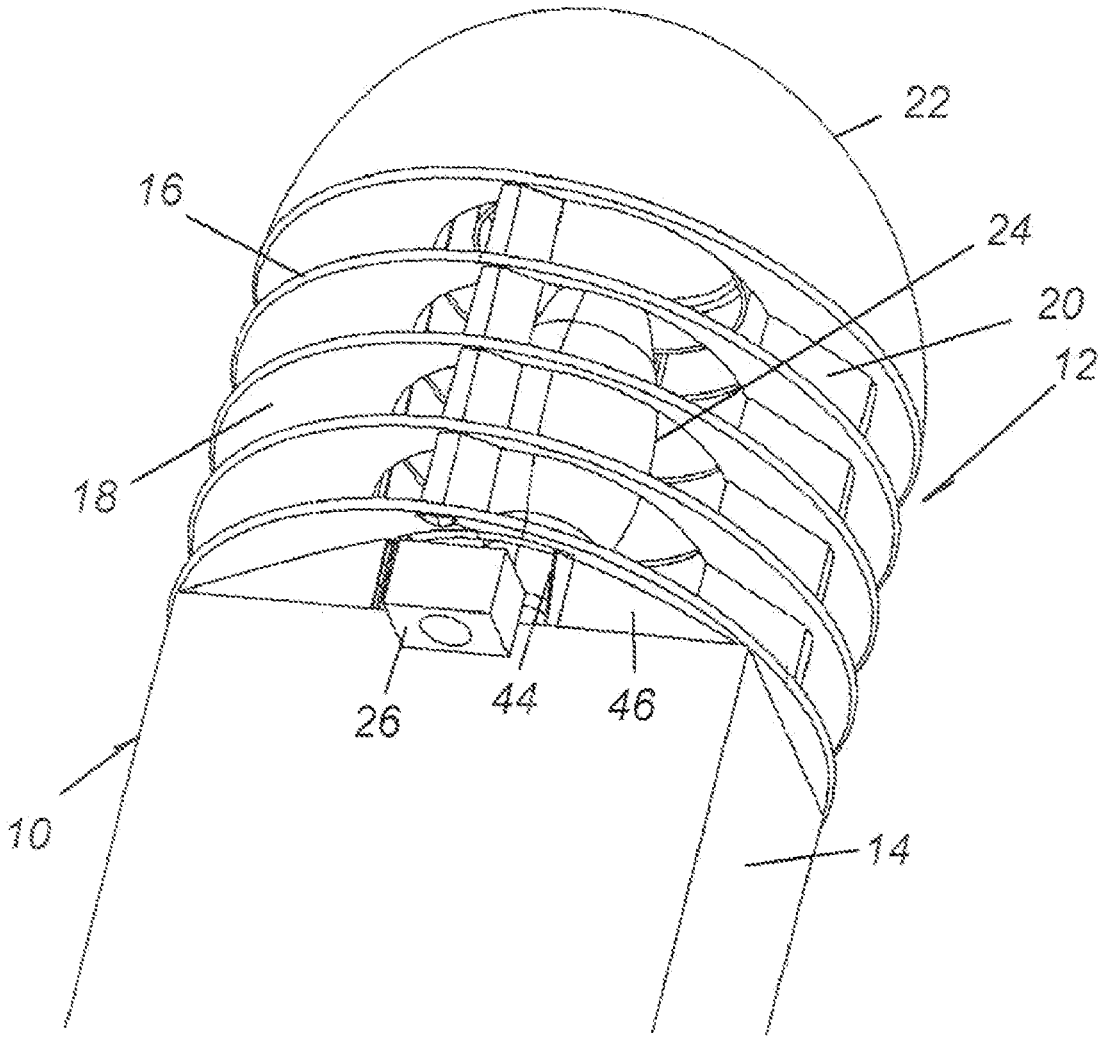
FIG. 1 is a bottom perspective view of a stacked louver bollard lamp with an LED as a down light means.

FIG. 1 illustrates a first embodiment employing a bollard 10 of rectangular cross section. A lamp, generally designated 12, sits atop the bollard post 14. The lamp 12 is made up of what is commonly referred to as a louver stack 16 composed of a plurality of louvers 18 which are spaced apart in the longitudinal direction of the bollard post 14 and supported by vertical elements 20. A dome 22 provides an opaque cap for the lamp 12. The louver stack 16 is shown to be cylindrical in shape but may be of other shapes including hemicylindrical if employed against a wall.

Located within the center of the louver stack 16 is a primary light source 24. The light source 24 is shown to be a bulb.

The louvers 18 extend outwardly past the periphery of the top end of the bollard post 14 at least in one segment. Below the umbrella of the lowermost louver 18 which is most adjacent the top of the bollard post 14, an LED module 26 defines a down light means for directing light downwardly about the base end of the bollard post 14. The LED 26 is shown positioned to provide a light wash down the bollard post 14. The LED 26 may be separately wired from the primary light source 24 and may employ specific light wavelengths for architectural effect.

Figure 2:
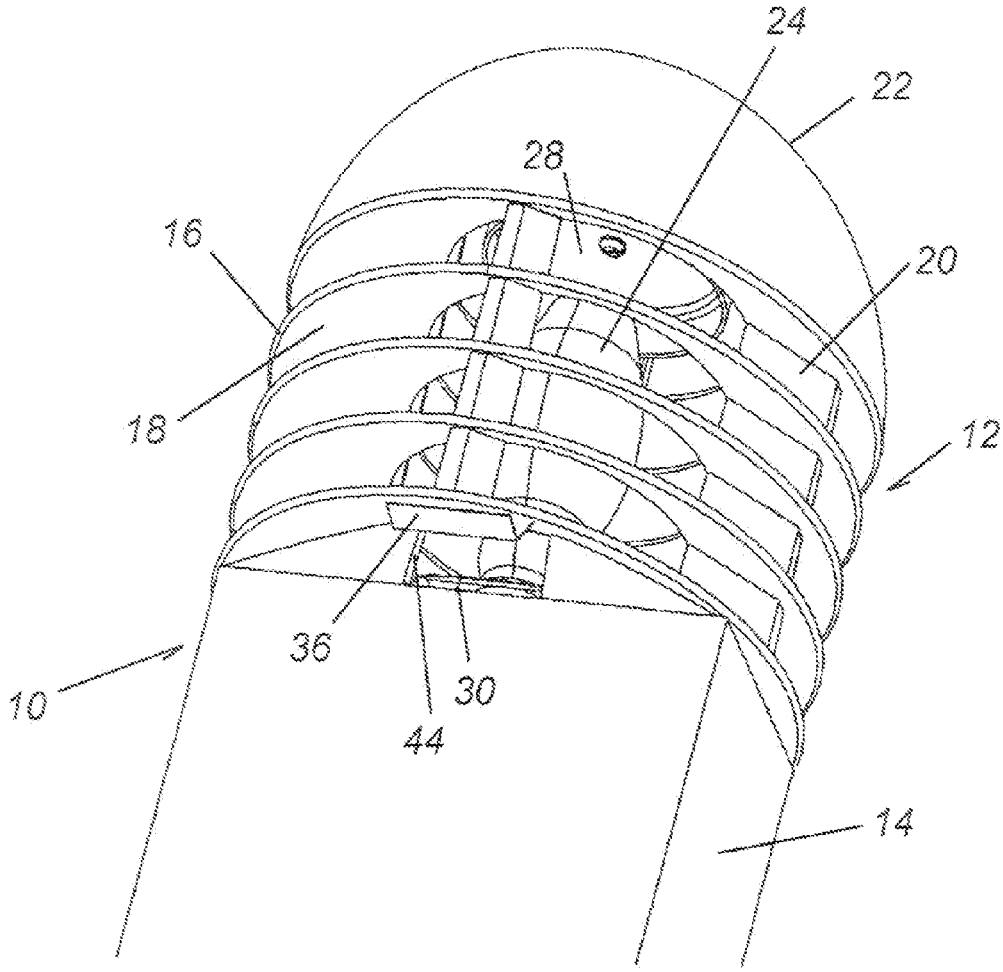
FIG. 2 is a bottom perspective view of a stacked louver bollard lamp using a primary light source as a dome light means.
Figure 3:
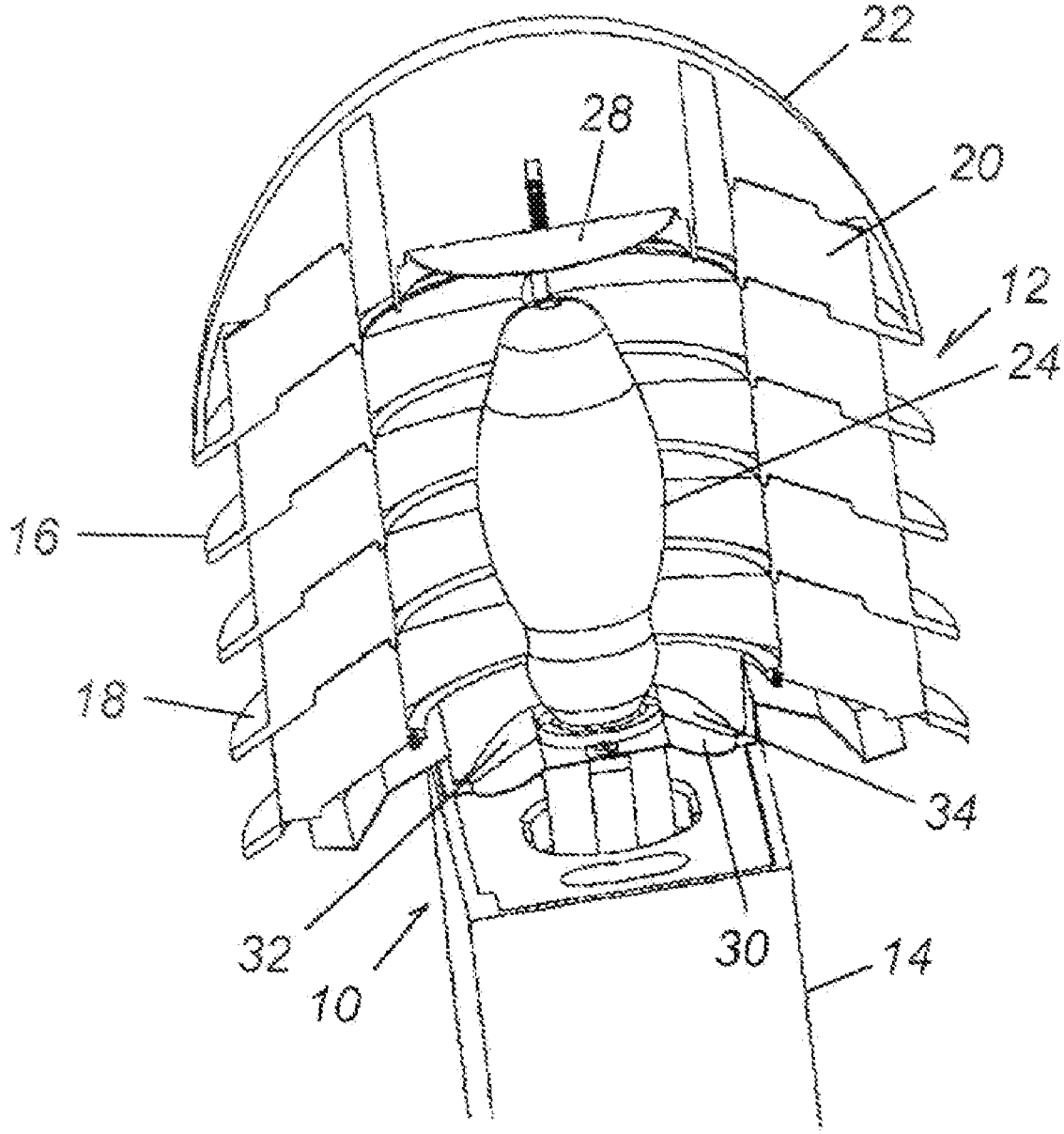
FIG. 3 is a perspective view of the stacked louver bollard of FIG. 2 with the louvers in the foreground sectioned for clarity of illustration.
Figure 4:
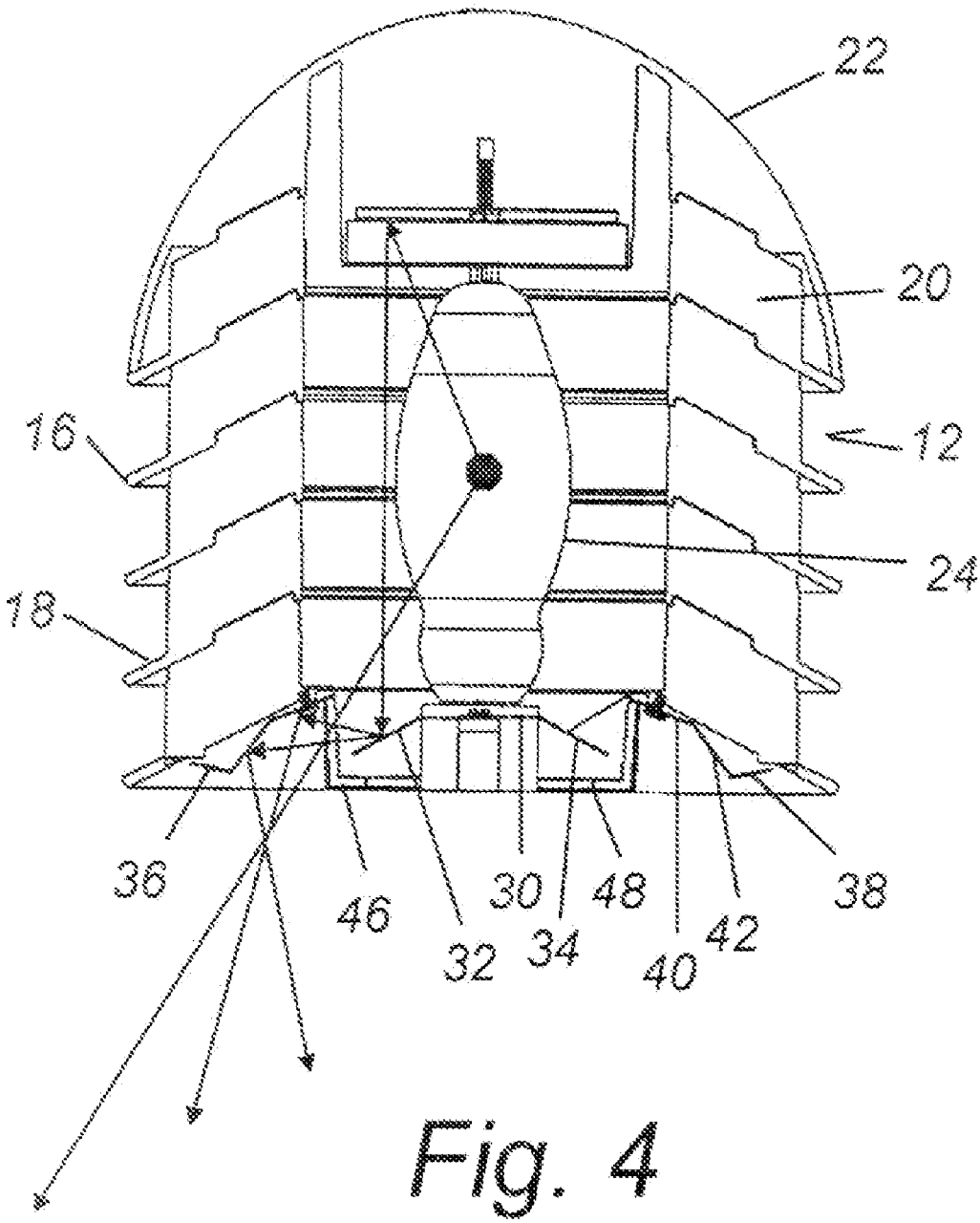
FIG. 4 is a cross-sectional elevation schematically illustrating light paths of the lamp of FIG. 2.

FIGS. 2, 3 and 4 illustrate a second embodiment of the present invention. The basic structures of the bollard post 14, louvered stack 16 with its louvers 18 and the dome 22 are the same. A primary light source 24 is also similarly positioned.

To achieve a down light means for directing light downwardly about the base end of the bollard post 14, a top reflector 28 is located above the primary light source 24. This top reflector 28 receives light from the primary light source 24 and directs that reflected light downwardly about the primary light source 24 to a bottom reflector 30. The bottom reflector 30, as can be seen in FIG. 4, is inclined to receive light from the top reflector 28 and direct that light outwardly toward the louver 18 which is the bottom most louver and most adjacent the bollard post 14. In this embodiment, there are two reflective surfaces 32, 34 defining the bottom reflector 30. Thus, in this embodiment, light is directed outwardly in two directions. These directions are toward the narrow sides of the rectangular bollard post 14.

Outwardly of the bottom reflector 30 intercepting light from both reflector surfaces 32, 34 are louver reflectors 36, 38. The louver reflectors 36, 38 in the light paths from the bottom reflector 30 are also inclined to reflect light from the bottom reflector 30 downwardly to about the base end of the bollard post 14. The lower reflectors 36, 38 as illustrated in the disclosed embodiment each define two surfaces 40, 42 to reflect light in two different directions. As illustrated, the surface 40 directs light to about the base of the bollard post 14 while the surface 42 directs light as a light wash down the bollard post 14.

The several reflectors are shown in substantially simple form. The surfaces may be curved or have additional facets to advantageously reflect light in broader or other advantageous patterns.

As with the LED embodiment described above, this embodiment employing the primary light source 24 for creating a down light effect is configured such that the lowermost louver 18 extends past the periphery of the top end of the bollard post 14 on two sides of the post 14 of rectangular cross section. With the louver reflectors 36, 38 located below the lowermost louver 18, the extension of that louver outwardly past the periphery of the bollard post 14 provides a clear path for light to travel downwardly as either a wash light or an area light about the bollard 10. Additionally, the opening defined between the inner edge of the lowermost louver 18 and the top of the bollard post 14 defined on either side of the bollard post 14 is further exposed to the primary light source such that light is directly transmitted from the primary light source 24 to an area about the bollard 10 which would otherwise be in shadow from the louver stack 16. The hole 44 defined in the supporting angles 46, 48 may be of any appropriate width.

Thus, a bollard lamp is disclosed which provides for lighting of the base area around the bollard. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A bollard comprising a bollard post having a top end and a base end;

a lamp on the top end of the bollard post including a louver stack defining at least a segment of the periphery of the lamp, the louver stack including louvers spaced apart in the longitudinal direction of the bollard post, at least the louver closest to the top end of the bollard post extending laterally of the bollard post past the periphery of the top end of the bollard post in at least one location, a primary light source inwardly of the louvers for directing light between the louvers and at least one LED at the louver most adjacent the bollard at the at least one location for directing light in a light wash of the bollard post.

* * * * *